US008683840B2

(12) United States Patent
Tuma et al.

(10) Patent No.: US 8,683,840 B2
(45) Date of Patent: Apr. 1, 2014

(54) METHOD FOR PRODUCING CLOSURE ELEMENTS FOR METAL TOUCH-AND-CLOSE FASTENERS ACCORDING TO THE METHOD

(75) Inventors: Jan Tuma, Herrenberg (DE); Metin Efe, Aidlingen (DE)

(73) Assignee: Gottlieb Binder GmbH & Co.. KG, Holzgerlingen (DE)

( * ) Notice: Subject to any disclaimer, the term of this patent is extended or adjusted under 35 U.S.C. 154(b) by 338 days.

(21) Appl. No.: 12/735,117

(22) PCT Filed: Dec. 13, 2008

(86) PCT No.: PCT/EP2008/010621

§ 371 (c)(1),
(2), (4) Date: Jun. 17, 2010

(87) PCT Pub. No.: WO2009/089881

PCT Pub. Date: Jul. 23, 2009

(65) Prior Publication Data

US 2010/0257704 A1 Oct. 14, 2010

(30) Foreign Application Priority Data

Jan. 19, 2008 (DE) ..... 10 2008 005 178

(51) Int. Cl.
*B21D 13/00* (2006.01)

(52) U.S. Cl.
USPC ..... 72/186; 29/557; 24/442; 24/452

(58) Field of Classification Search
USPC ..... 24/442, 452; 29/557; 72/186
See application file for complete search history.

(56) References Cited

U.S. PATENT DOCUMENTS

| | | | | | |
|---|---|---|---|---|---|
| 3,011,226 | A | * | 12/1961 | Menge | 411/466 |
| 3,089,191 | A | * | 5/1963 | Bert | 425/383 |
| 3,546,754 | A | * | 12/1970 | Erb | 24/450 |
| 3,557,407 | A | * | 1/1971 | Lemelson | 425/71 |
| 3,899,803 | A | | 8/1975 | Brumlik | |
| 4,615,084 | A | * | 10/1986 | Erb | 24/442 |
| 5,345,659 | A | * | 9/1994 | Allan | 24/442 |
| 5,385,706 | A | * | 1/1995 | Thomas | 264/519 |
| 5,512,234 | A | * | 4/1996 | Takizawa et al. | 264/511 |
| 6,524,507 | B1 | * | 2/2003 | Clune | 264/167 |

FOREIGN PATENT DOCUMENTS

| | | | |
|---|---|---|---|
| DE | 1 940 793 | A | 8/1970 |
| DE | 10 2004 048 464 | A1 | 4/2006 |
| DE | 10 2006 015 145 | A1 | 10/2007 |
| WO | WO 03/035300 | A1 | 5/2003 |

* cited by examiner

*Primary Examiner* — Robert J Sandy
*Assistant Examiner* — David Upchurch
(74) *Attorney, Agent, or Firm* — Roylance, Abrams, Berdo & Goodman LLP

(57) ABSTRACT

To produce closure elements for metal touch-and-close fasteners in a metal carrier (3), notches (13) corresponding to the outlines of hook elements (1) are made, while leaving a connecting line for each notch. Bending operations are carried out to raise the regions delimited by the notches (13) out of the plane of the carrier (3) as hooking elements (1) around the connecting lines serving as bending lines. The carrier (3) is guided through the region (5) of the tooth engagement between rotational bodies (7, 9) having peripheral teeth. The tooth shapes of the rotational bodies (7, 9) and the type of the tooth engagement are selected such that the tooth engagement cuts the notches (13) and stamps the metal carrier the bending operations.

17 Claims, 4 Drawing Sheets

METHOD FOR PRODUCING CLOSURE ELEMENTS FOR METAL TOUCH-AND-CLOSE FASTENERS ACCORDING TO THE METHOD

FIELD OF THE INVENTION

The invention relates to a method for producing closure elements for metal touch-and-close fasteners. Notches, corresponding to the outline of the hooking elements to be formed, are made in a metal carrier, while leaving a respective connecting line. Bending processes are carried out to raise the regions bordered by the notches out of the plane of the carrier as hooking elements around the connecting lines serving as bending lines. Moreover, the invention relates to a closure element produced according to this method.

BACKGROUND OF THE INVENTION

A method of this type is disclosed in DE 10 2006 015 145 A1. Producing a metal touch-and-close fastener provides the advantages of proven plastic-based touch-and-close fastener systems, as have become widely used for a plurality of applications, in those applications in which plastic touch-and-close fasteners cannot be used, for example due to the lack of temperature stability, overly low mechanical strength, and the like. In hooking elements of temperature-resistant metal alloys, for example high-grade steel, these metal touch-and-close fasteners can also be used in areas of application in which high thermal and mechanical loads occur. These fastening systems enable prompt and simple mounting of third parts without the need for additional holding devices and their actuation by special tools.

One major disadvantage of metal touch-and-close fastener systems isthat production of metal closure elements is complicated compared to plastic touch-and-close fasteners, is time-consuming, and is therefore expensive. Difficulties for producing a sufficient number of hooking elements involve making a large number of notches, for example by punching. After the punching, processes of shaping by bending must be carried out on each region of the pertinent carrier bordered by the notches to raise the hooking elements and to bring them into the hook shape suitable for hook engagement.

SUMMARY OF THE INVENTION

An object of the invention is to provide a method for simple, efficient, and economical production of closure elements for metal touch-and-close fasteners.

This object is basically achieved according to the invention by a method in which complete execution of each hooking element is carried out by a combined working step including both the cutting process and the embossing process that effects shaping by bending. Also the respective combined cutting and embossing process is carried out in a continuous process by the carrier being routed through the engagement region of the intermeshing teeth of bodies of revolution. In this way, an extremely large number of hooking elements, proceeding from a still unprocessed carrier, can be formed in continuous process at a very high operating speed to the final finished state. Thus, metal touch-and-close fasteners can be produced especially efficiently and with a very high operating speed.

Preferably, at least one of the bodies of revolution is set into rotation by a drive, and the carrier in the form of a strip is pulled through the engagement region of the teeth by the feed force produced by the drive. Especially high operating speeds can thus be achieved.

Especially advantageously, several adjacent rows of hooking elements can be formed on the carrier by bodies of revolution in the form of roller disks having several adjacent rows of teeth on their periphery.

In the process, notches in a rectangular shape are preferably formed with long sides extending in the direction of the teeth and with at least one short side is formed by the connecting line that has been left.

One especially advantageous pattern of the hooking elements can be formed such that adjacent rows of hooking elements are designed with the hooking elements in rows adjacent to one another being offset to one another in the longitudinal direction. Hooking elements are then aligned to one another in every other row.

The hooking elements in each row can be raised by the bending taking place in the same direction around the bending line. Alternatively the hooking elements in rows adjacent to one another can be raised with bending directions opposite one another around the bending line. Depending on the requirements prevailing in the respective application, touch-and-close fasteners can be implemented providing the desired holding force against lifting of the carriers off one another and a defined locking force against displacement movements of the carriers.

In this context advantageously the hooking elements in each row can be raised with alternating bending directions around the bending line.

The subject matter of the invention is also a closure element produced according to the method according to the invention.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 2:
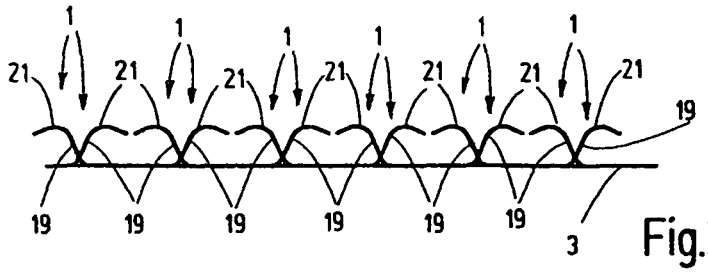
FIG. 2 is a side elevational view of the section shown in FIG. 1.
Figure 1:
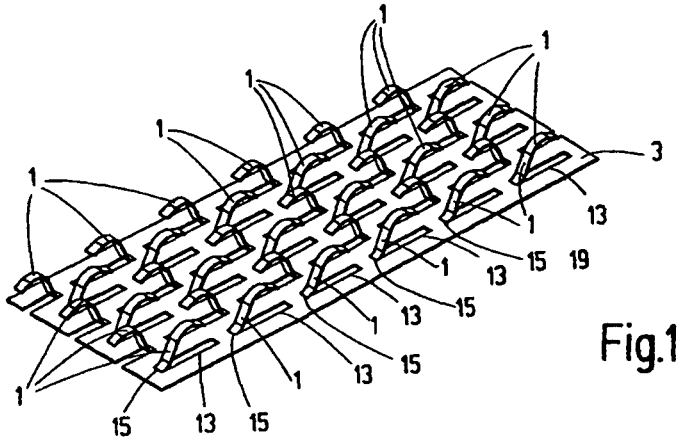
FIG. 1 is a perspective view of one section of a closure element according to a first exemplary embodiment of the invention.
Figure 3:
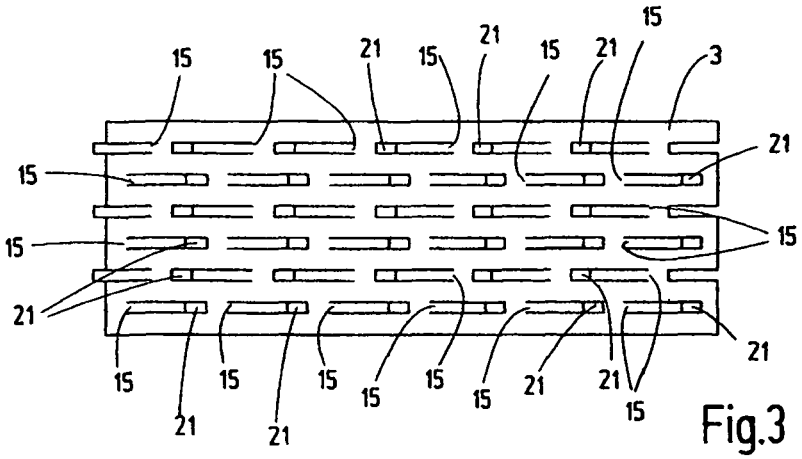
FIG. 3 is a top plan view of the section shown in FIGS. 1 and 2.
Figure 4:
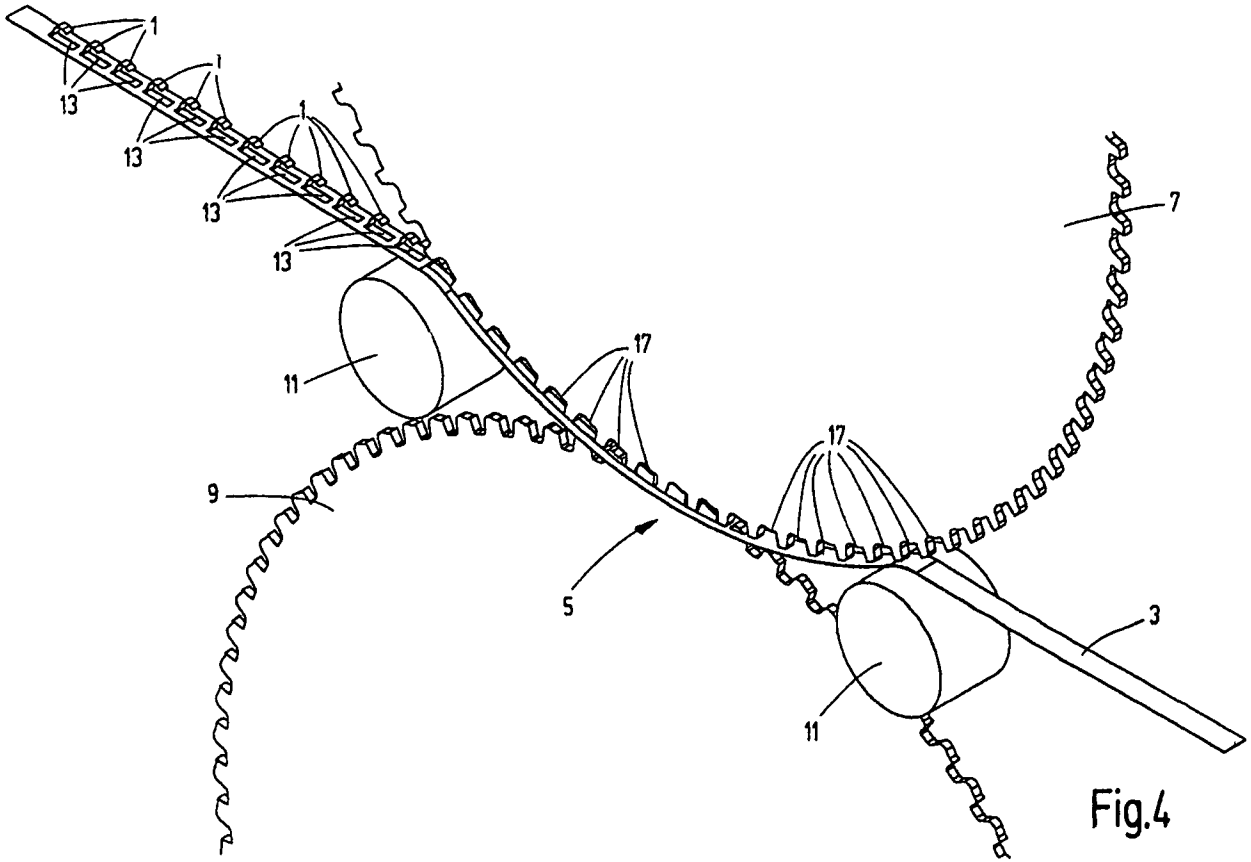
FIG. 4 is a partial, highly schematic and simplified perspective view of only that part of a device for combined cutting and embossing processes taking place by tooth engagement to illustrate the progression of the method according to an exemplary embodiment of the invention.
Figure 6:
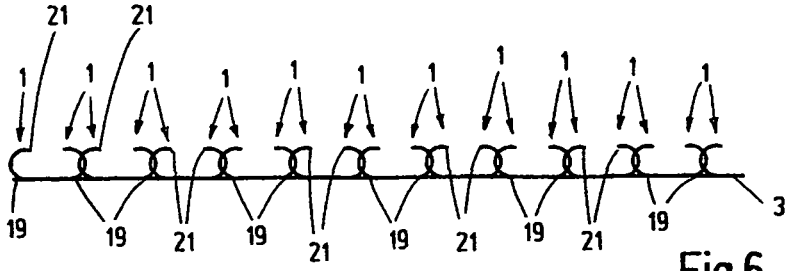
FIG. 6 is a side elevation view of the section shown in FIG. 5.

FIG. 4 illustrates the progression of the method according to the invention for producing closure elements with hooking elements 1 having a hook shape as shown in the examples of FIGS. 1 to 3, where not all hooking elements 1 are numbered. As shown in FIG. 4, a still unformed, strip-shaped metal carrier 3, for example of a high-grade steel alloy and with a material thickness of 0.1 to several mm, depending on the application of the closure element to be produced, is routed through the region 5 of tooth engagement between two revolving roller disks 7 and 9 having peripheral teeth. Guide rolls 11 are located in front of and behind the engagement region 5. In the example from FIG. 4, at least one of the roller disks 7, 9 can be rotated by a drive so that the carrier strip 3 is pulled through the region 5 by the feed force acting in the engagement region 5, i.e., is moved to the left in FIG. 4. As is likewise apparent from this figure, the tooth shapes and flank clearance are selected and matched to one another such that in the region 5 on the carrier strip 3, which has not yet been worked, a combined cutting and bending process takes place in which the teeth of the roller disk 9 carry out a type of punching process from the lower or underneath side of the strip 3 in FIG. 4. Notches 13, of which only some are numbered in the figures, are formed in the shape of rectangles elongated in the feed direction, the rectangular shape being closed on the connecting lines 15. The connecting lines extend in the transverse direction to the feed direction and form bending lines around which the respective inner region of the notches 13 is raised. This raising takes place by the front region of the teeth of the roller disk 9. These regions of the teeth are active in cutting (punching). The pertinent regions also pressing into the tooth gaps 17 (only a few in FIG. 4 are numbered) of the roller disk 7. The inside walls of the tooth gaps 17 are shaped such that pressing the material regions into the tooth gaps 17 conducts an embossing process for forming the tooth shape of the hooking elements 1 shown in FIGS. 1 to 4.

As is best illustrated in FIGS. 1 and 2, the hooking elements 1 adjacent to the bending lines, i.e., the connecting lines 15, each have a base part 19 extending obliquely to the plane of the carrier strip 3 as well as a hook end part 21 connected to the foot part. Each hook end part is arched in the direction to the carrier strip 3. These hook end parts 21 are only numbered in FIG. 2 and partially in FIG. 3.

While in FIG. 4 a narrow carrier strip 3 is pulled through the region 5 in which there is only one row of teeth for forming only one row of hooking elements 1, FIGS. 1 to 3 illustrate examples in which six adjacent rows of hooking elements 1 are formed at the same time by several adjacent rows of teeth. As is best illustrated in FIGS. 1 and 3, the hooking elements 1 for all adjacent rows are shaped the same. The bending direction in which the hooking elements 1 is bent around the connecting lines 15 being the same within each row. But, for the rows adjacent to the hooking elements 1 aligned with one another in the transverse direction, the bending direction is reversed so that the hooking elements 1 which are aligned with one another in the transverse direction are oriented the same in every other row.

Figure 7:
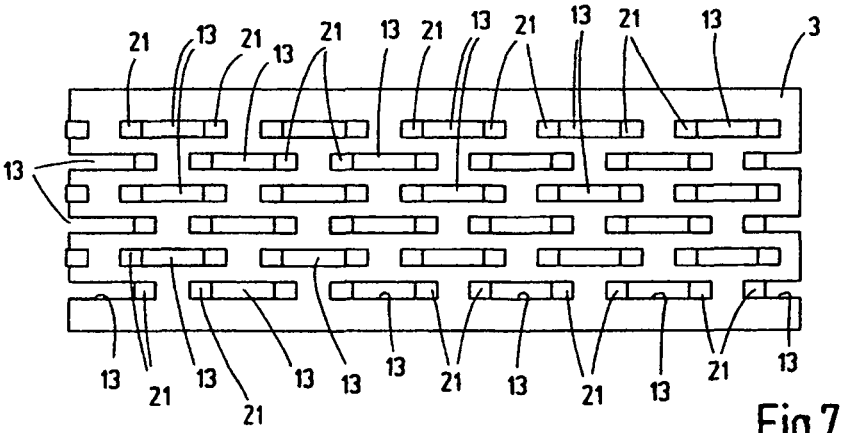
FIG. 7 is a top plan view of the section in FIG. 5.
Figure 8:
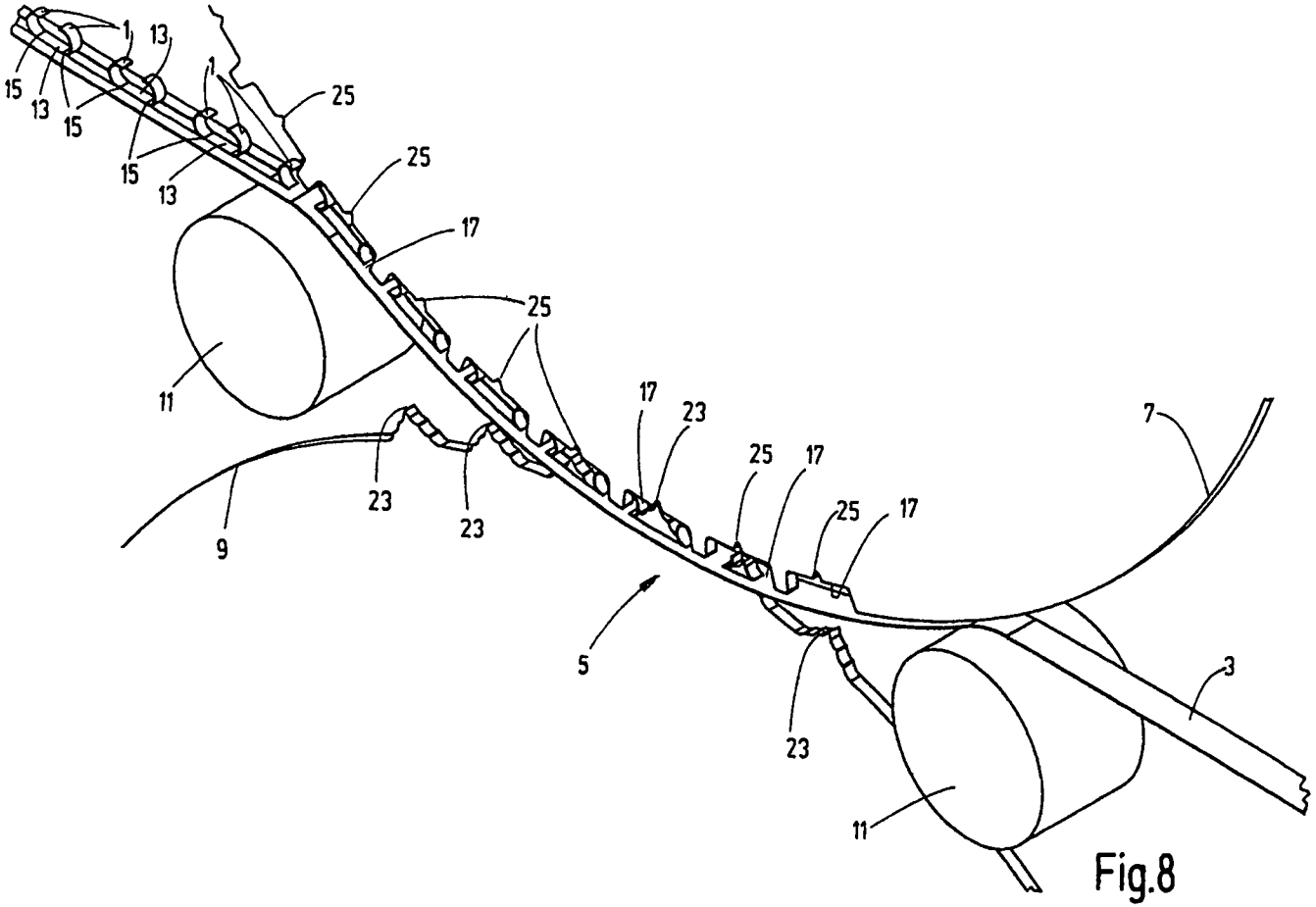
FIG. 8 is a partial, highly schematic and simplified perspective view of only that part of a device for combined cutting and embossing processes taking place by tooth engagement to illustrate the progression of the method for producing closure elements with hooking elements in a C-shaped hook form, according to a second exemplary embodiment of the invention.

In contrast, the example shown in FIGS. 5 to 8 differs essentially in two respects from the example in FIGS. 1-4. First, each of the rectangular notches 13 is bordered on the two short sides by a connecting line 15, of which only some are numbered in the figures, and the hooking elements 1 have a C shape. As FIG. 8 illustrates, this shape is effected by the teeth of the roller disk 9 having a centrally placed, projecting cutting edge 23 extending in the transverse direction. When the teeth engage, cutting edge 23 engages a die depression 25 in the tooth gaps 17 of the roller disk 7 such that the carrier strip 3 is cut by the cutting edge 23. In this way, one partial inner region of each notch 13 at a time can be raised around one connecting line 15 and another, i.e., two hooking elements 1 result on each notch 13. These hooking elements, according to the shape of the tooth gaps 17 of the roller disk 8, are embossed in a C-shape, i.e., they have a continuous arch proceeding from the base part 19 to the hook end part 21. For the sake of clarity of the drawings in FIGS. 5 to 8, not all the notches 13, connecting lines 15, tooth gaps 17, base parts 19, and hook end parts 21 are numbered.

Figure 5:
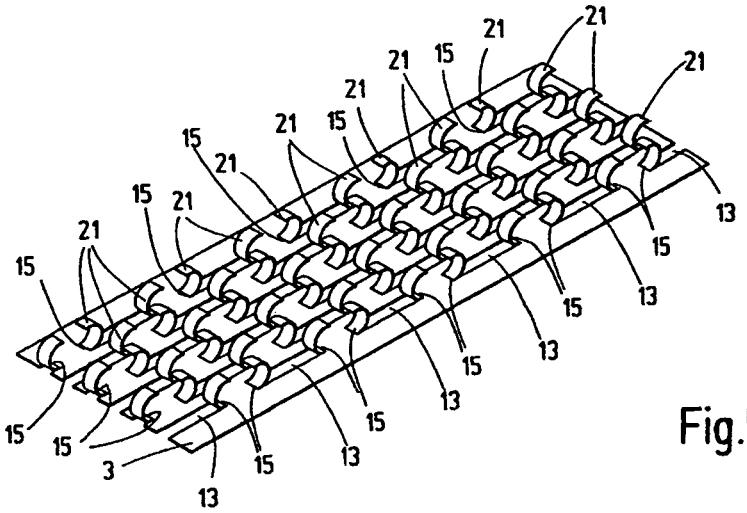
FIG. 5 is a perspective view of one section of a closure element according to a second exemplary embodiment of the invention.

FIGS. 5 and 7 illustrate the arrangement and orientation of the C-shaped hooking elements 1. As is apparent, the hooking elements 1 in the transverse rows are each bent alternately in one bending direction or the other or opposite bending direction around the connecting lines 15. For successive hooking elements 1, the open sides of the C-shape are then facing one another. The hooking elements 1 in the adjacent rows, as in the example from FIGS. 1 to 4, are offset relative to one another such that the hooking elements 1 in every other row are oriented aligned to one another in the transverse direction. Depending on the application, other types of patterns of hooking elements 1 can be formed, as to the hook shape, orientation, dimensioning of the hook width and hook length, repetition frequency in the rows of hooks, and the like.

While various embodiments have been chosen to illustrate the invention, it will be understood by those skilled in the art that various changes and modifications can be made therein without departing from the scope of the invention as defined in the appended claims.

The invention claimed is:

1. A method for producing closure elements for metal touch-and-close fasteners, comprising the steps of:

routing a metal carrier through a tooth engagement region between two bodies of revolution having peripheral teeth; and cutting notches in the metal carrier while leaving connecting lines and embossing the notches in bending processes about the connecting lines serving as bending lines to raise regions bordered by the notches out of a plane of the metal carrier into hook-shaped hooking elements with each hook-shaped element having a base part extending from the metal carrier and a hooked end part extending from the base part remote from the metal carrier by shapes of the teeth and engagement of the teeth of the two bodies.

2. A method according to claim 1 wherein at least one of the bodies of rotation is rotated by a drive; and the metal carrier is strip-shaped and is pulled into the engagement region by a force produced by the drive.

3. A method according to claim 1 wherein several rows of the hooking elements are formed by the bodies of revolution being roller disks with several rows of teeth on peripheries thereof spaced along an axis of rotation of the roller disks.

4. A method according to claim 1 wherein each of the notches has a rectangular shape with long sides extending in a circumferential direction of the teeth and with one short side formed by the respective connection line.

5. A method according to claim 3 wherein adjacent rows of hooking elements are made such that hooking elements in adjacent rows are offset relative to one another in a longitudinal direction and are aligned with one another in the longitudinal direction in every other row.

6. A method according to claim 4 wherein hooking elements in each row are raised by bending in a same direction about the connecting lines.

7. A method according to claim 6 wherein hooking elements in adjacent rows are raised by bending in opposite directions relative to one another about the connecting lines.

8. A method according to claim 4 wherein hooking elements in each row are raised by bending in alternating bending directions opposite one another about the connecting lines.

9. A method according to claim 4 wherein the long sides and one short side of each of the notches is cut by the teeth, with the one short side cut by the teeth forming a free end of the respecting hooking element.

10. A method for producing closure elements for metal touch-and-close fasteners, comprising the steps of:

routing a metal carrier through a tooth engagement region between two bodies of revolution being roller disks having several rows of peripheral teeth spaced along an axis of rotation of the roller disks; and cutting several rows of notches in the metal carrier while leaving connecting lines, and embossing the notches in bending processes about the connecting lines serving as bending lines to raise regions bordered by the notches out of a plane of the metal carrier into hooking elements by shapes of the teeth and engagement of the teeth of the two bodies; and adjacent rows of hooking elements being made such that hooking elements in adjacent rows are offset relative to one another in a longitudinal direction and are aligned with one another in the longitudinal direction in every other row.

11. A method according to claim 10 wherein each of the notches has a rectangular shape with cut long sides extending in a circumferential direction of the teeth and with one short side formed by the respective connection line and one cut short side.

12. A method for producing closure elements for metal touch-and-close fasteners, comprising the steps of:

routing a metal carrier through a tooth engagement region between two bodies of revolution having peripheral teeth; and cutting notches in the metal carrier while leaving connecting lines such that each of the notches has a rectangular shape with long sides extending in a circumferential direction of the teeth and with one short side formed by the respective connection line and one cut short side, and embossing the notches in bending processes about the connecting lines serving as bending lines to raise regions bordered by the notches out of a plane of the metal carrier into hooking elements by shapes of the teeth and engagement of the teeth of the two bodies, such that hooking elements in each row are raised by bending in a same direction about the connecting lines.

13. A method according to claim 12 wherein hooking elements in adjacent rows are raised by bending in opposite directions relative to one another about the connecting lines.

14. A method according to claim 12 wherein hooking elements in each row are raised by bending in alternating bending directions opposite one another about the connecting lines.

15. A method for producing closure elements for metal touch-and-close fasteners, comprising the steps of:

routing a metal carrier through a tooth engagement region between two bodies of revolution having peripheral teeth; and cutting notches in the metal carrier while leaving connecting lines such that each of the notches has a rectangular shape with long sides extending in a circumferential direction of the teeth and with one short side formed by the respective connection line, and embossing the notches in bending processes about the connecting lines serving as bending lines to raise regions bordered by the notches out of a plane of the metal carrier into hooking elements by shapes of the teeth and engagement of the teeth of the two bodies, hooking elements in each row being raised by bending in alternating bending directions opposite one another about the connecting lines.

16. A method according to claim 1 wherein each hooked end part has a free end spaced from and detached from the metal carrier.

17. A method according to claim 16 wherein the regions are bent about lines in the regions spaced from the connecting lines, with each hook-shaped element having an elongated part between the respective connecting line and the hooked end part thereof.

* * * * *